US006971170B2

(12) United States Patent
Mou et al.

(10) Patent No.: US 6,971,170 B2
(45) **Date of Patent: *Dec. 6, 2005**

(54) METHOD OF MANUFACTURING PRINTHEAD

(75) Inventors: Tse-Chi Mou, Hsin-Chu (TW); Ying-Lun Chang, Hsin-Chu (TW); Cheng-Hung Yu, Hsin-Chu (TW); Chin-Yi Chou, Hsin-Chu (TW)

(73) Assignee: Microjet Technology Co., Ltd, Hsin-Chu (TW)

( * ) Notice: Subject to any disclaimer, the term of this patent is extended or adjusted under 35 U.S.C. 154(b) by 515 days.

This patent is subject to a terminal disclaimer.

(21) Appl. No.: 10/123,346

(22) Filed: Apr. 16, 2002

(65) Prior Publication Data

US 2002/0108243 A1 Aug. 15, 2002

Related U.S. Application Data

(63) Continuation-in-part of application No. 09/536,158, filed on Mar. 28, 2000.

(51) Int. Cl.[7] ..... B21D 53/76
(52) U.S. Cl. ..... 29/890.1; 29/846; 347/63; 216/27

(58) Field of Search ..... 29/890.1, 611, 29/25.35, 831, 846, 847; 347/63–67, 20, 347/44; 438/21; 216/19, 27

(56) References Cited

U.S. PATENT DOCUMENTS

| | | | | |
|---|---|---|---|---|
| 4,513,298 A * | 4/1985 | Scheu | ..... | 247/64 |
| 4,535,343 A * | 8/1985 | Wright et al. | ..... | 347/64 |
| 4,809,428 A * | 3/1989 | Aden et al. | ..... | 29/611 |
| 6,623,109 B2 * | 9/2003 | Mou et al. | ..... | 347/63 |

* cited by examiner

*Primary Examiner*—Minh Trinh
(74) *Attorney, Agent, or Firm*—Madson & Metcalf

(57) ABSTRACT

A method of manufacturing a printhead for raising its product acceptance rate and improving its quality is provided. The method of manufacturing printheads includes steps of providing a base layer, forming a pattern layer on the base layer by a semi-conductor manufacturing process, forming a dry film of a channel barrier layer having an ink channel, a flow channel and plural ink cavities on the pattern layer; and adhering a nozzle plate on the dry film of the channel barrier layer by thermal compression. The pattern layer further includes a flow pattern and a base pattern surround a central location reserved for the ink channel, wherein the base pattern comprises at least a heating layer and a passivation layer, and the flow pattern is made of the same material and at the same height as the base pattern.

9 Claims, 8 Drawing Sheets

METHOD OF MANUFACTURING PRINTHEAD

FIELD OF THE INVENTION

This is a continuation-in-part application of U.S. patent application Ser. No. 09/536,158, filed on Mar. 28, 2000. The present invention is related to a method of manufacturing printhead, more particularly to a method of manufacturing printhead for raising its product acceptance rate and improving its quality.

BACKGROUND OF THE INVENTION

In the current market of computer printers, ink-jet printers are relatively inexpensive in terms of good quality they offer. As compared with laser printers, each type of printers has its respective strengths and weaknesses. The ink-jet printers are lower priced but cost more in printing. The laser printers are more expensive, but cost less in printing. Therefore, for the ink-jet printers, the goal of lowering printing cost for greater competitiveness becomes a pressing task for further research and development.

Any ink-jet printing technology generally includes controlling means for releasing ink to a printing surface. Regarding a ink-jet printing technology in the prior art, a printhead is fitted to a ink-jet cartridge, which releases ink jets in response to control signals.

Two methods are generally employed by the printhead for releasing ink jets, thermal-bubble and piezoelectricity methods. In the thermal-bubble method, the printhead employs a membrane resistor that heats up small portion of ink (ink droplets) to gaseous state rapidly for releasing in jets through the nozzle.

In the piezoelectricity method, the printhead employs a piezoelectric element that compresses the volume of the ink in response to control signals for creating pressure waves and then forcing of ink droplets in jet though the nozzle.

one type of printheads for thermal-bubble ink-jet printers has been disclosed in the prior art, which is a layer structure manufactured via the VLSI manufacturing process, such as the layer structure disclosed in the U.S. Pat. No. 4,513,298. This layer structure is a three-dimensional structure gradually formed via multiple manufacturing steps. FIG. 1 shows the plane elevated view of the printhead layer structure. The nozzle plate is removed in FIG. 1 for clear illustration of the layer structure. As shown in FIG. 1, the components of the printhead includes at least the followings in proper order from the bottom to the top: a base layer 11, a pattern layer 12 and a dry film of a channel barrier layer 13. This structure is manufactured via the VLSI manufacturing process with add-in silicon chips. The topmost layer of the dry film of the channel barrier layer 13 is represented by dotted lines in FIG. 1. FIGS. 2 and 3 illustrate the printhead structure and mechanism. FIG. 2 is a close-up view of the nozzle cavity and FIG. 3 is a cross-sectional view of the nozzle cavity, which shows the layer structure of one nozzle cavity. The dry film of the channel barrier layer 13 shown in FIG. 1 is situated on the top of the pattern layer 12 and forms an ink channel 131 in the center of the channel barrier layer 13 and a plurality of ink cavities 132 formed on the two sides of the ink channel 131.

As shown in FIG. 2, an ink first flows, via an ink cartridge (not shown), into an ink channel 131 and then into each ink cavity 132. Referring to FIG. 3, where the nozzle plate 14 and the dry film of a channel barrier layer 13 are thermally compressed together for tight adhesion. The nozzle plate 14 has a plurality of openings corresponding to each ink cavity 132. With ink flowed into it, the ink of each nozzle cavity 132 is heated up by the heating layer 121 of the pattern layer 12 in response to the control signals from the printer, so that the ink expands in volume and is jetted out through the openings of the nozzle plate 14.

FIG. 3 further illustrates the layer structure of the printhead, in which the base layer 11 includes a silicon base layer 111 and a silicon dioxide layer 112 for forming the base of the printhead, and the pattern layer 12 includes a heating layer 121, a first passivation layer 122 and a second passivation layer 123 for forming the ink-heating structure for the printhead.

FIG. 4 is a cross-sectional view along the A—A line of the printhead shown in FIG. 1. It can be seen that when the pattern layer 12 is formed on the two sides of the ink channel 131, there emerges a height differential (about 0.6 $\mu$m) between the pattern layer 12 and the gap which is formed at the ends of the ink channel 131 because there is none pattern layer 12 arranged on the two opposite ends of the ink channel 131. Hence as the dry film of channel barrier layer 13 is formed on its top, a step differential d of about 0.6 $\mu$m is created at the ink channel 131. When adhering nozzle plate 14 (usually made of nickel) unto the dry film of a channel barrier layer 13 (usually high polymer compound of Morton, Vacrel or the likes), high temperature at 120° C. and high pressure are needed for 2 to 5 minutes for the high polymer to combine with the nozzle plate 1.

Referring to FIG. 4 again, as the nozzle plate 14 is thermally pressed along the directions pointed by the arrows for adhesion with the dry film of the channel barrier layer 13, a greater pressure is required to deform the dry film of channel barrier layer 13, so that it pushes and squeezes the ink channel 131 for closing up gaps created by the step differential d for preventing the ink leakage though such gaps.

However, the great tangential shear force B, generated by the great pressure which is due to the thermal compression of FIG. 4, may cause the dry film of the channel barrier 13 in each ink cavity 132 to be deformed transversely so that it leads to reduce internal volume and raise higher printhead ill rates. Generally, the tolerable error for the size of the ink cavity 132 is within +/−10 $\mu$. If the thermal pressure is too high, the ill rate will increase.

As the step differential d of pattern layer 12 is responsible for causing in the compression process of the nozzle plate 14, the primary object of the present invention is to provide a manufacturing method for the printhead and the structure thereof, which can reduce the differential on the two opposite ends of ink channel 131, so that the dry film of channel barrier layer 13 is made smoother, and the nozzle plate 14 can adhere tightly with the dry film of channel barrier layer 131 for eliminating the ink leakage problem.

SUMMARY OF THE INVENTION

It is an object of the present invention to provide a method of manufacturing a printhead for raising its product acceptance rate and improving its quality.

According to the present invention, a method of manufacturing printhead, comprising steps of providing a base layer; forming a pattern layer on the base layer by a semi-conductor manufacturing process, wherein the pattern layer includes a flow pattern disposed on two opposite ends of the base layer and having a space location reserved for a flow channel; and a base pattern disposed on two opposite sides of the base layer and having plural caved locations reserved for plural ink cavities, wherein the flow pattern and the base pattern surround a central location reserved for an ink channel, the base pattern comprises at least a heating layer and a passivation layer, and the flow pattern is made of the same material and at the same height as the base pattern; forming a dry film of a channel barrier layer having the ink channel, the flow channel and the plural ink cavities on the pattern layer; and adhering a nozzle plate on the dry film of the channel barrier layer by thermal compression, wherein the nozzle plate has plural ink opening disposed over said ink cavities.

Certainly, the heating layer can be made of tantalic aluminum (TaAl).

Certainly, the first passivation can be made of one of silicon nitride (Si3N4) and silicon carbide (SiC).

Certainly, the second passivation can be made of tantalum (Ta).

Certainly, the nozzle plate can be made of nickel (Ni).

Certainly, the base pattern and the flow pattern can be in discontinuously alternate arrays.

Preferably, the flow pattern comprises a first flow pattern and a second flow pattern disposed in discontinuously arrays and forming a flow channel.

Preferably, the flow pattern is formed in response to a first flow pattern and a second flow pattern disposed in discontinuously arrays and forms a flow channel.

Preferably, the first passivation layer and the second passivation layer of the pattern layer is formed in continuous shape and the heating layer of the base pattern 31 and the flow pattern 32 are disposed in discontinuously arrays.

According to the present invention, a method of manufacturing printhead, comprising steps of providing a base layer; forming a pattern layer on the base layer by a semi-conductor manufacturing process, wherein the pattern layer includes a flow pattern disposed on two opposite ends of the base layer and having a space location reserved for a flow channel; and a base pattern disposed on two opposite sides of the base layer and having plural caved locations reserved for plural ink cavities, wherein the flow pattern and the base pattern surround a central location reserved for an ink channel, the flow pattern includes a first flow pattern and a second flow pattern disposed in discontinuously arrays and forming a flow channel; forming a dry film of a channel barrier layer having the ink channel; and adhering a nozzle plate on the dry film of the channel barrier layer.

Now the foregoing and other features and advantages of the present invention will be more clearly understood through the following descriptions with reference to the drawings, wherein:

DETAILED DESCRIPTION OF THE PREFERRED EMBODIMENT

In printing by thermal bubble ink-jet printers, ink droplets are heated so that they are expanded and shoot out in jets onto a printing paper. The related factors affecting printing effect include the ink quality, the internal pressure control and the printhead of the cartridge. For thermal bubble ink-jet printers, the controlling factor shall be the manufacture of the printhead.

Figure 1:
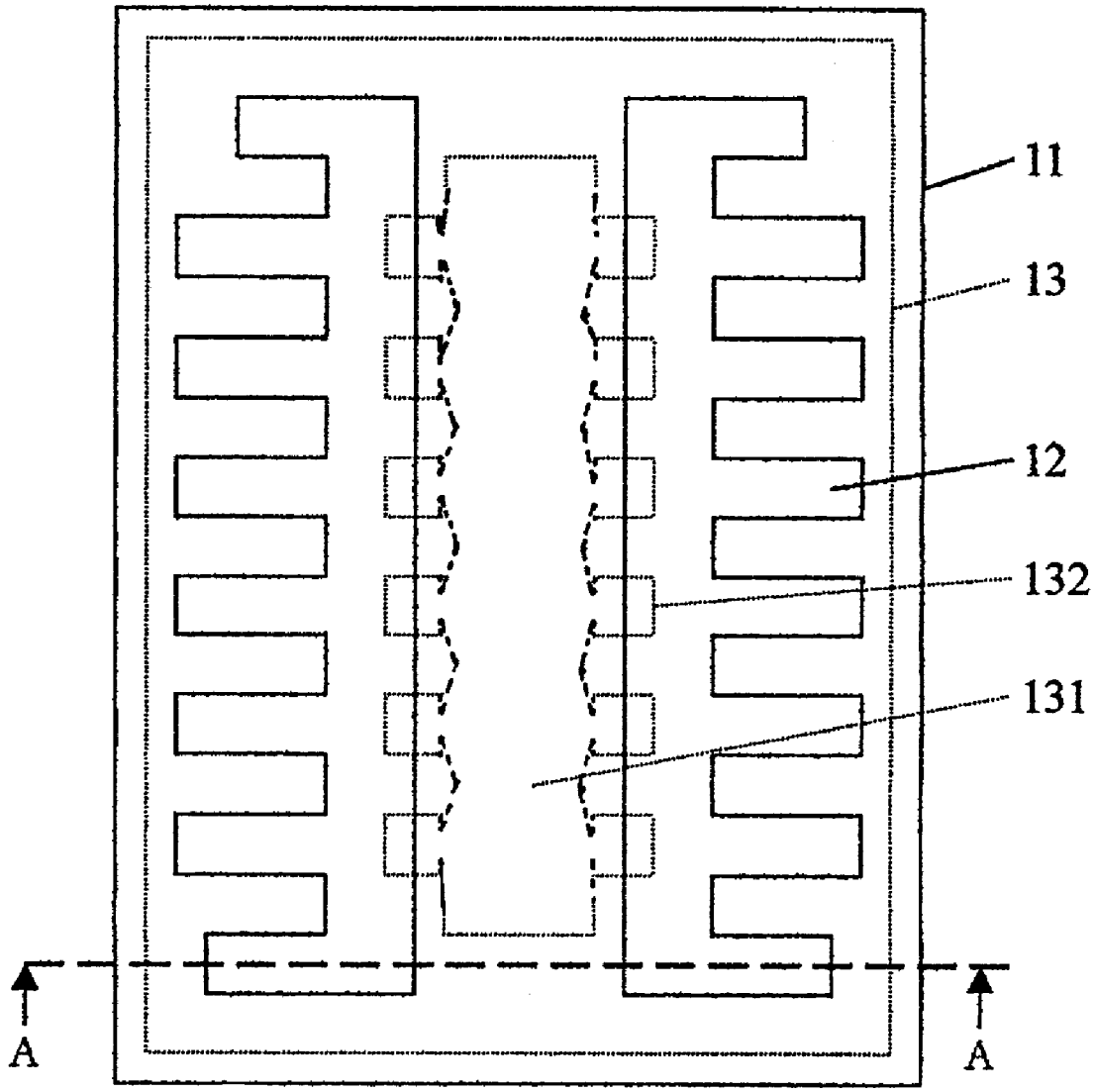
Fig. 1(PRIOR ART)
FIG. 1 illustrates a plane elevated view of the conventional printhead layer structure with the nozzle plate removed according to prior art.
Figure 2:
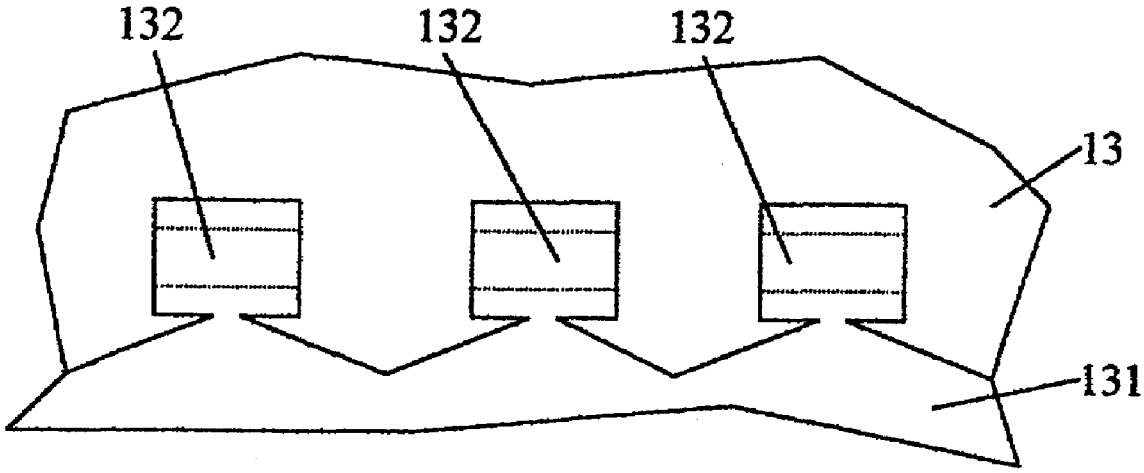
Fig. 2(PRIOR ART)
FIG. 2 illustrates a partially close-up view of the nozzle cavity according to prior art.
Figure 3:
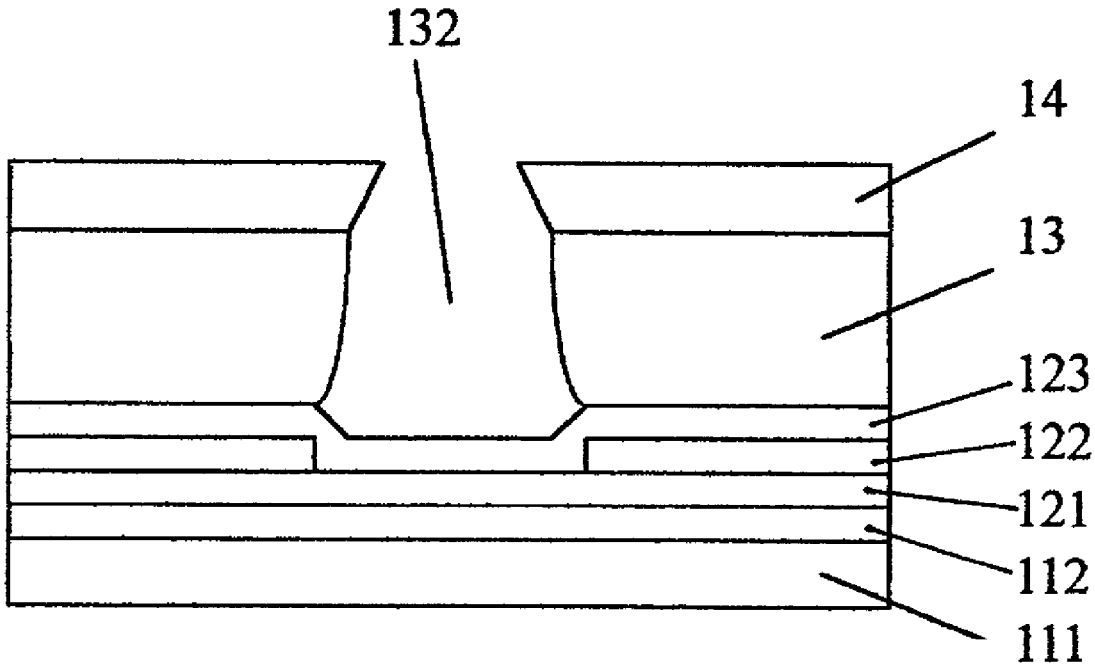
Fig. 3(PRIOR ART)
FIG. 3 illustrates a cross-sectional view of the nozzle cavity according to prior art.
Figure 4:
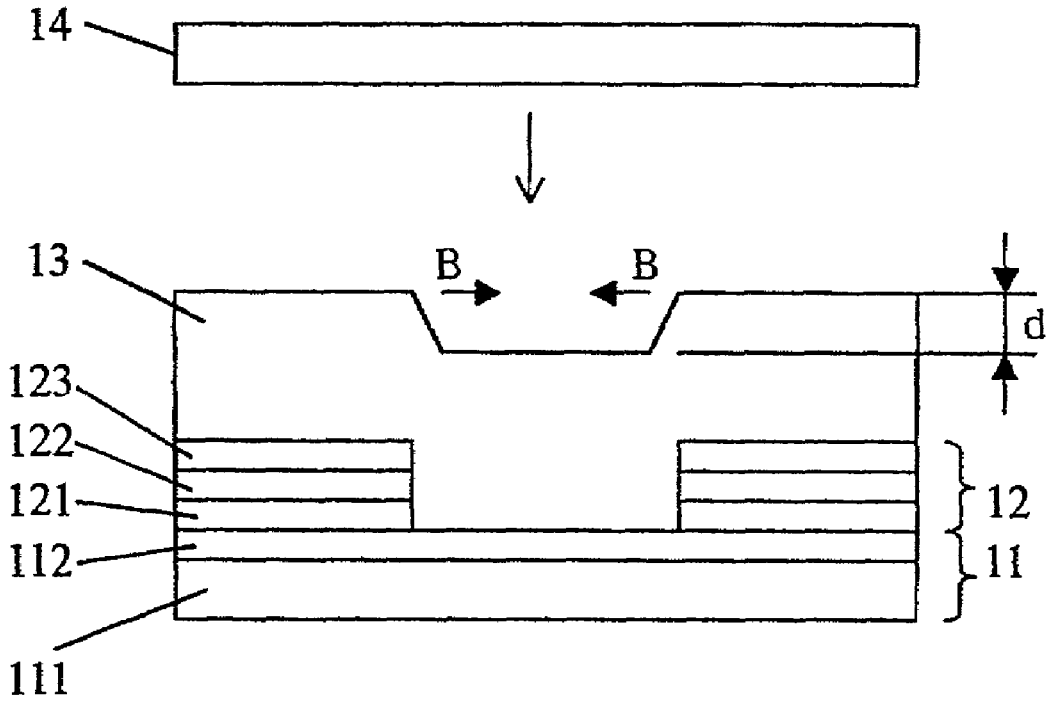
Fig. 4(PRIOR ART)
FIG. 4 illustrates a cross-sectional view along the A—A line of FIG. 1.
Figure 5:
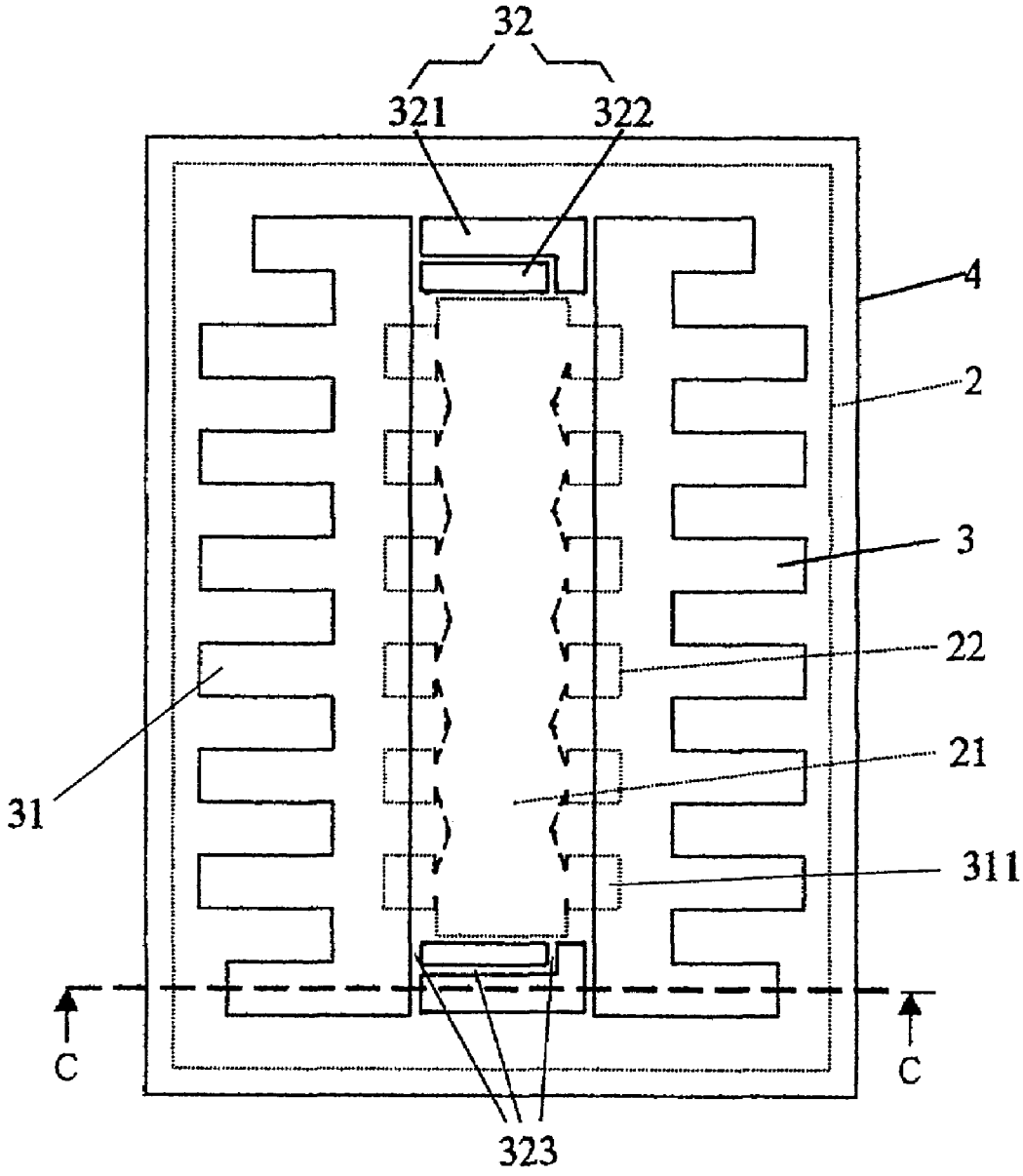
FIG. 5 illustrates a plane elevated view of the first preferred embodiment of the printhead layer structure of the present invention with the nozzle plate removed.

The printhead of the present invention includes a structure of a heating chip combined with a nozzle plate, which forms 50 to 300 independent nozzle openings. At the bottom of each nozzle cavity is an electrical resistor, which heats up instantly in response to an electric current passing therethrough and can vaporize ink. And then the ink of the nozzle cavities is expanded in volume and the ink droplets are sprayed onto a printing paper. As shown in FIG. 5, in the present invention, the heating chip includes a dry film of a channel barrier layer 2, a pattern layer, a flow pattern 32 and a base layer 4. And the heating chip is manufactured by the VLSI manufacturing process. The nozzle plate 5 is manufactured by micromachining etching on nickel to form multiple apertures, each of which corresponds to an independent nozzle opening. Both VLSI manufacturing process and micromachining etching are familiar to semi-conductor manufacturers, so their detailed discussion is omitted here.

Figure 6:
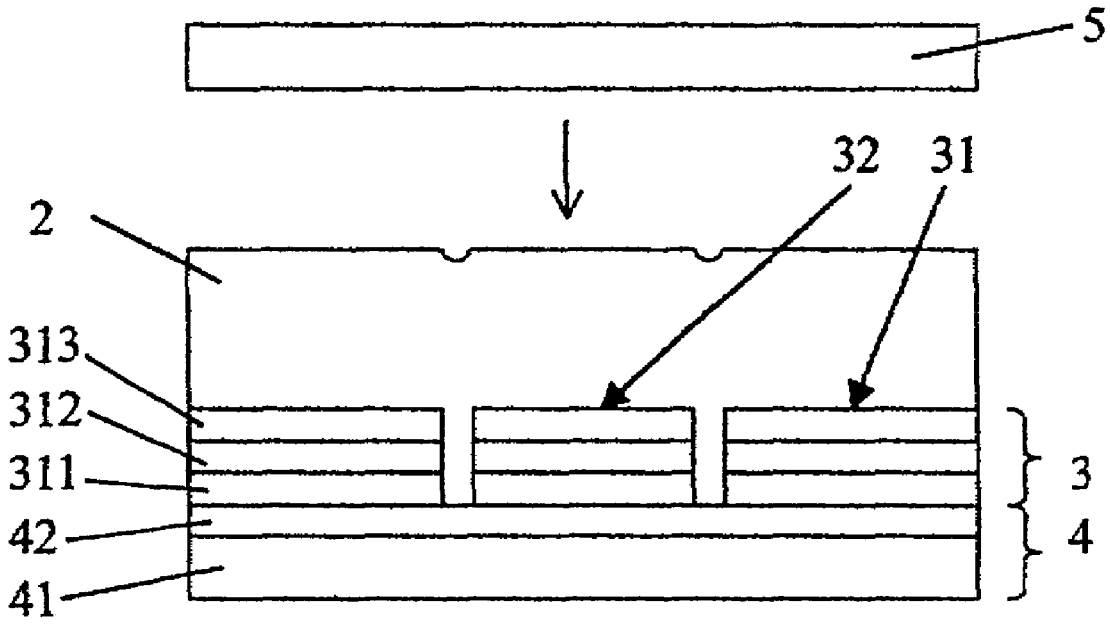
FIG. 6 illustrates a cross-sectional view along the C–C' line of FIG. 5.

The printhead is manufactured by adhering heating chip made by VLSI manufacturing process with the nozzle plate 5. Additionally, the nozzle plate 5 is made by etching by compressing them together inside high-pressure mold in high temperature (about 120° C.). During process of the adhesion, it should be taken care to avoid any formation of minute cracks around the peripheries of the nozzle plate 5 and the dry film of the channel barrier layer 2. Otherwise, ink leakage will develop in printing. Referring to FIGS. 5 and 6. The manufacturing method includes several steps for the heating chip production.

First, silicon for marking a silicon semi-conductors chip is used as the material for the base layer 4 of the printhead, which contains a silicon layer 41 and a silicon dioxide layer 42. The base layer 4 is flat surfaced in preparation for the following VLSI manufacturing process.

Secondly, by the method of sputtering or masking, the desired pattern layer 3 is formed on the base layer 4. The pattern layer 3 includes a base pattern 31 and a flow pattern 32. The base pattern 31 is formed on two sides of the base layer 4 and has plural apertures 311 reserved for plural ink cavities 22. The base pattern 31 by means of aforementioned manufacturing process includes at least three layers: a heating layer 311, a first passivation layer 312 and a second passivation layer 313. The material of the heating layer 311 may be TaAl and the first passivation layer 312 may be Si3N4 or SiC. The material of the second passivation layer 313 may be Ta. The heating layer 311 is for producing heat in response to electric current passing therethrough and the first and second passivation layers 312 and 313 are for preventing any chemical reaction between the ink and the heating layer 311. In the present invention, the flow pattern 32 is formed simultaneously with the formation of the integrated circuit layout. The flow pattern 32 forms on two opposite ends of the base layer 4 and has space locations reserved for a flow channel 323. Furthermore, the flow pattern 32 is disposed in discontinuously alternate arrays against to the base pattern 31 so that the flow pattern 32 will not come in substantial contact with the base pattern 31. FIG. 5 also illustrates a flow pattern 32 including a first flow pattern 321 in shape of a rectangle and a second flow pattern 322 in shape of "L" wherein the first flow pattern 321 and the second flow pattern 322 are disposed in discontinuously alternate arrays to form flow channels 323. Nonetheless, those skilled in this art should all realize that the flow pattern 32 is not limited to the shape shown in FIG. 5, insofar as any layout which is discontinuous and forms on two ends of the base layer 4 between the base pattern 31. Wherein the flow pattern 32 and the base pattern 31 surround a central location reserved for an ink channel 21. In FIG. 6, the flow pattern 32 is formed together along with the heating layer 311, the first passivation layer 312 and the second passivation layer 313 so that the layers are all of the same material and therefore at the same height as the pattern layer 31.

Thirdly, referring to FIG. 5, the dry film of the channel barrier layer 2 (usually made of Morton or Vacrel high polymer compounds or the likes,) forms on top of the pattern layer 3 to become a structure represented by the dotted lines, and thus the dry film of the channel barrier layer 2 forms the ink channel 21 connecting with a plurality of nozzle cavities 22 on both sides at the center of a chip.

As shown in FIG. 6, the heating chip adheres to the nozzle plate 5 having a plurality of openings by thermal compression. No step differential exists, but only with slight cavities of the flow channel 323, at the peripheries of the dry film of the channel barrier layer 2 on the chip. Although the base pattern 31 and the flow pattern 32 are disposed in discontinuously alternate arrays and the dry film of the channel barrier layer 2 forms the flow channels 323 with slight cavities, therefore no great pressure force is required during the thermal pressurization, and the pressure force can be evenly distributed throughout the chip without causing large local shape deformation of the dry film of the channel barrier layer 2. Hence not only is even adhesion of the nozzle plate 5 achieved but the product acceptance rate can also be significantly improved.

Figure 7:
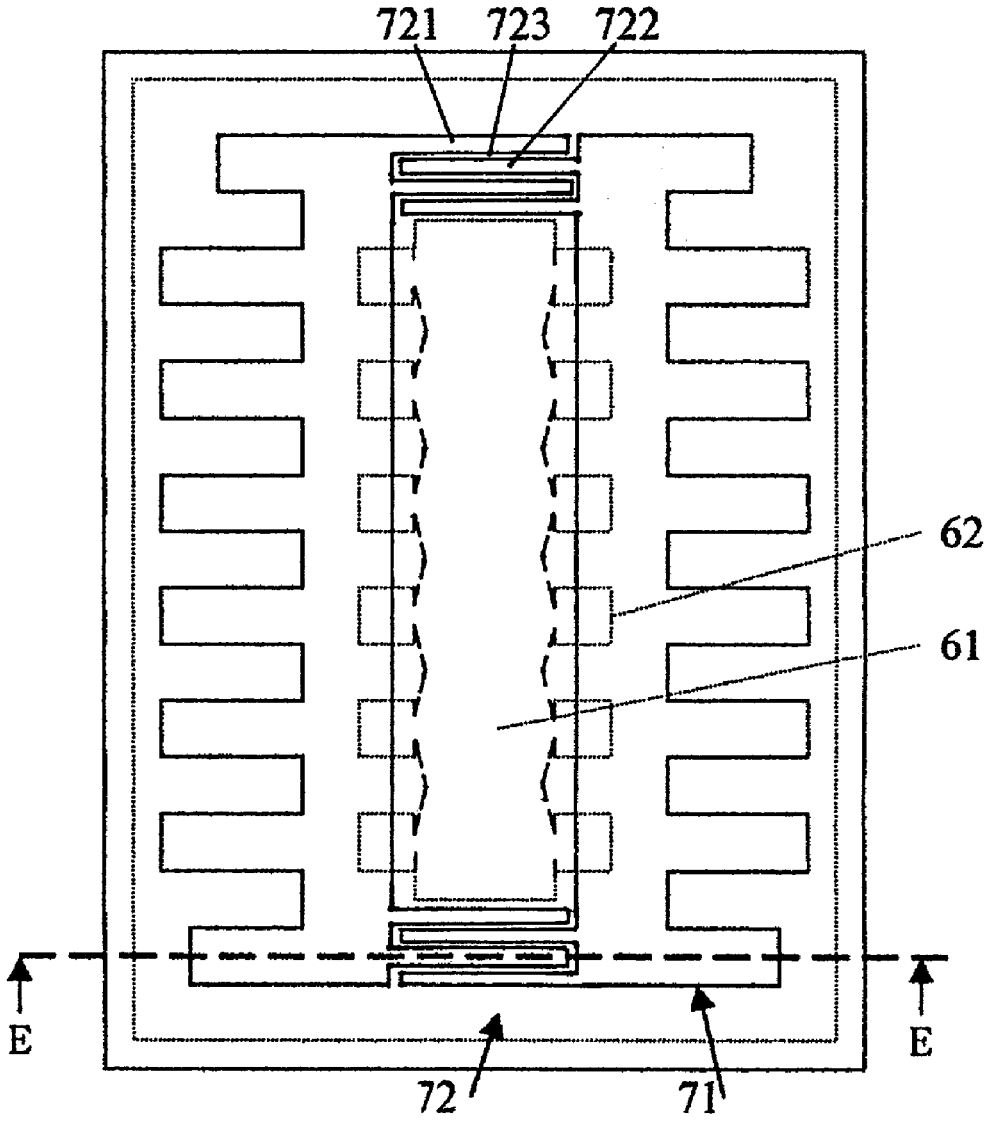
FIG. 7 illustrates a plane elevated view of the second preferred embodiment of the printhead layer structure of the present invention with the nozzle plate removed.
Figure 8:
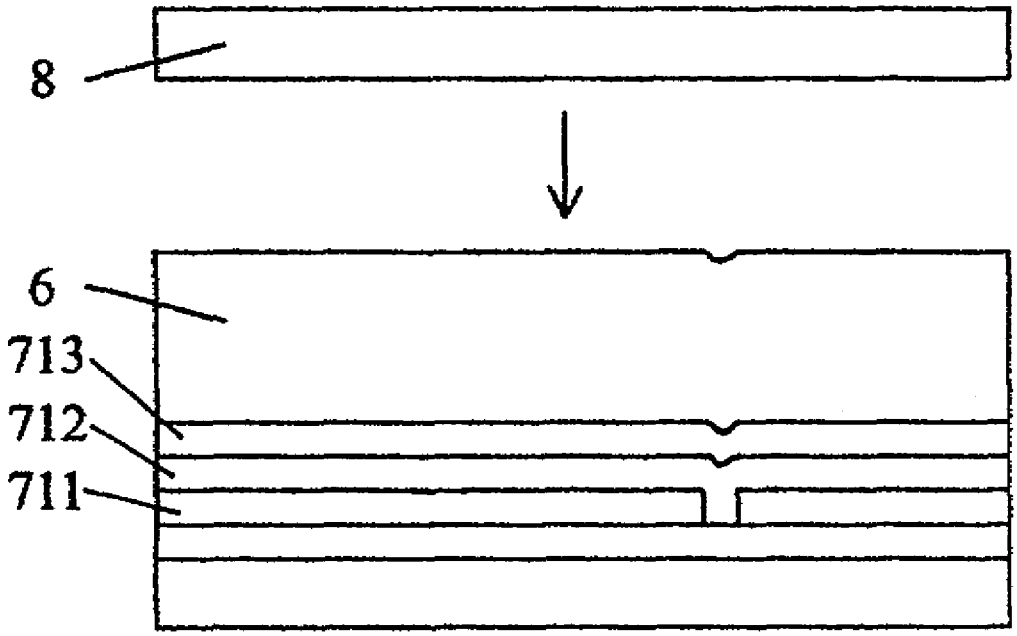
FIG. 8 illustrates a cross-sectional view along the E–E' line of FIG. 7.

FIG. 7 illustrates the second preferred embodiment of the printhead layer structure of the present invention. It shows another preferred embodiment of the flow pattern 72 which forms on two side of the base layer 4 between the base pattern 71. Wherein the flow pattern 72 includes a first flow pattern 721 and a second flow pattern 722 in which the first flow pattern 721 and the second flow pattern 722 are respectively extended from the base pattern 71 in discontinuously alternate arrays and form a flow channel 723. As shown in FIG. 8, the heating layer 711 between the first flow pattern 721 and the second flow pattern 722 is disposed in discontinuously arrays and forms a flow channel 723, but the first passivation layer 712 and the second passivation layer 713 are formed continuously. The flow pattern 72 is formed together along with the base pattern 71, the heating layer 711, the first passivation layer 712 and the second passivation layer 713 so that the layers are all of the same material and therefore at the same height as the pattern layer 71.

In second embodiment, the base pattern 71 and the first passivation layer 712 and the second passivation 713 of the flow pattern 72 are formed continuously. Merely, the heating layer 711 is in discontinuously arrays. Hence the slight cavities formed due to the dry film of the channel barrier layer 6 are smaller than those of the first embodiment. The pattern layer 71 and the flow pattern 72 are at the same height. No great pressure force is required to achieve adhesion of the nozzle plate 8 during the thermal pressurization, and the pressure force can be evenly distributed throughout the chip without causing large local shape deformation of the dry film of the channel barrier layer 6. Moreover, the first flow pattern 721 and the second flow pattern 722 of the flow pattern 72 are in discontinuously alternate arrays and the flow channel 723 is formed circuitously. Hence the effect of the adhesion of the nozzle plate 8 is better, the possibility of ink leakage is substantially decreased and the product acceptance rate can also be significantly improved.

Printheads manufacture pursuant to the method described herein shall be of high quality that exhibits a low ill rate. The associated cost is low and this method can be used in conjunction with the conventional printhead manufacturing machine with modified masking layouts. No new production equipment is required for implementing this method. The method of the present invention can provide a low cost and great benefit invention.

In conclusion, the present invention possesses many outstanding characteristics, effectively improves upon the drawbacks associated with the prior art in practice and application, produces practical and reliable products, bears novelty and adds to economical utility value.

Although the present invention has been described and illustrated in detail, it is to be clearly understood that the same is by the way of illustration and example only and is not to be taken by way of limitation, the spirit and scope of the present invention being limited only by the terms of the appended claims.

What is claimed is:

1. A method of manufacturing printhead, comprising steps of:

(a) providing a base layer;

(b) forming a pattern layer on said base layer by a semi-conductor manufacturing process, wherein said pattern layer includes:

a flow pattern disposed bilaterally on two opposite ends of said base layer and having a space location reserved for a flow channel; and a base pattern disposed bilaterally on two opposite sides of said base layer and having plural apertures reserved for plural ink cavities, wherein said flow pattern and said base pattern surround a central location reserved for an ink channel, said base pattern comprises at least a heating layer and a passivation layer, and said flow pattern is made of said same material and at said same height as said base pattern;

(c) forming a dry film of a channel barrier layer having said ink channel, said flow channel and said plural ink cavities on said pattern layer; and (d) adhering a nozzle plate on said dry film of said channel barrier layer by thermal compression, wherein said nozzle plate has plural ink opening disposed over said ink cavities.

2. The method according to claim 1 wherein said heating layer is made of tantalic aluminum (TaAl).

3. The method according to claim 1 wherein said first passivation is made of one of silicon nitride (Si3N4) and silicon carbide (SiC).

4. The method according to claim 1 wherein said second passivation is made of tantalum (Ta).

5. The method according to claim 1 wherein said nozzle plate is made of nickel (Ni).

6. The method according to claim 1 wherein said base pattern and said flow pattern are in discontinuously alternate arrays.

7. The method according to claim 6 wherein said flow pattern comprises a first flow pattern and a second flow pattern disposed in discontinuously arrays and forming a flow channel.

8. The method according to claim 1 wherein said flow pattern is formed in response to a first flow pattern and a second flow pattern disposed in discontinuously arrays and forms a flow channel.

9. The method according to claim 1 wherein said first passivation layer and said second passivation layer of said pattern layer is formed in continuous shape and said heating layer of said pattern layer and said flow pattern layer are disposed in discontinuously arrays.

* * * * *